US012595148B2

(12) United States Patent
Ishii

(10) Patent No.: US 12,595,148 B2
(45) Date of Patent: Apr. 7, 2026

(54) SHEET CONVEYING DEVICE AND IMAGE FORMING APPARATUS

(71) Applicant: KYOCERA Document Solutions Inc., Osaka (JP)

(72) Inventor: Satoshi Ishii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 268 days.

(21) Appl. No.: 18/605,522

(22) Filed: Mar. 14, 2024

(65) Prior Publication Data

US 2024/0317529 A1 Sep. 26, 2024

(30) Foreign Application Priority Data

Mar. 23, 2023 (JP) ..... 2023-046625

(51) Int. Cl.
*B65H 29/52* (2006.01)

(52) U.S. Cl.
CPC ..... *B65H 29/52* (2013.01); *B65H 2301/446* (2013.01)

(58) Field of Classification Search
CPC .... B65H 5/38; B65H 29/52; B65H 2301/446; B65H 2405/1412
USPC ..... 399/410
See application file for complete search history.

(56) References Cited

U.S. PATENT DOCUMENTS 7,168,701 B2 * 1/2007 Isaka ..... H04N 1/00538 271/301
7,950,659 B2 * 5/2011 Matsushima ..... G03G 15/6573 271/264
8,454,014 B2 * 6/2013 Kotera ..... B65H 5/062 271/272
10,942,483 B2 * 3/2021 Watanabe ..... B65H 31/02
12,311,681 B2 * 5/2025 Yamada ..... B41J 29/02

FOREIGN PATENT DOCUMENTS

JP 2012168424 A 9/2012

* cited by examiner

*Primary Examiner* — Leslie A Nicholson, III
(74) *Attorney, Agent, or Firm* — Alleman Hall LLP

(57) ABSTRACT

The present disclosure relates to a sheet conveying device that is mounted to an apparatus main body of an image forming apparatus and configured to be able to be pulled out forward from a mounting position. The sheet conveying device includes a lower guide member, an upper guide member, and a hinge portion that rotatably supports the upper guide member with respect to the lower guide member. A plurality of rib members are provided on an upper surface of the upper guide member. A flat guide portion is provided on the upper surface of the upper guide member and located farther above an upper end of the rib members. The sheet conveying device is configured such that if it is pulled out and the upper guide member is rotated, the upper guide member is supported in a position that opens a sheet conveying path.

5 Claims, 7 Drawing Sheets

SHEET CONVEYING DEVICE AND IMAGE FORMING APPARATUS

INCORPORATION BY REFERENCE

This application is based upon and claims the benefit of priority from the corresponding Japanese Patent Application No. 2023-046625 filed on Mar. 23, 2023, the entire contents of which are incorporated herein by reference.

The present disclosure relates to a sheet conveying device that is configured to be pulled out forward from a mounting position where the sheet conveying device is mounted to an apparatus main body of an image forming apparatus, and an image forming apparatus equipped with this sheet conveying device.

BACKGROUND

An electrophotographic image forming apparatus transfers a toner image from an image-carrying member to a sheet, and fixes the toner image to the sheet by a fixing device. The sheet after the image formation is discharged from a predetermined discharge port by a conveying roller or the like. Image forming apparatuses are known that include a conveying unit that conveys a sheet on which an image has been formed to a discharge port.

The conveying unit has a lower guide member and an upper guide member, and a sheet conveying path is defined between these guide members. The upper guide member is rotatably supported relative to the lower guide member with a rear side of the device as a fulcrum. The conveying unit is configured to be able to be pulled out forward from a predetermined mounting position on the image forming apparatus. Therefore, when a sheet becomes jammed in the conveying unit, the user pulls out the conveying unit, rotates the upper guide member upward, opens the sheet conveying path, and removes the jammed sheet.

SUMMARY

A sheet conveying device according to one aspect of the present disclosure is a sheet conveying device that is mounted to an apparatus main body of an image forming apparatus and is configured to be able to be pulled out forward from a mounting position where the sheet conveying device is mounted to the apparatus main body. The sheet conveying device includes: a lower guide member; an upper guide member that is arranged above the lower guide member and forms a sheet conveying path between the upper guide member and the lower guide member that extends in a first direction along an upper surface of the lower guide member and perpendicular to a pull-out direction; and a hinge portion provided at a rear end portion of the lower guide member on an opposite side to the pull-out direction and rotatably supports the upper guide member with respect to the lower guide member. A plurality of rib members extending in the first direction are provided on an upper surface of the upper guide member. A flat guide portion located farther upward than an upper end of the rib members is provided on the upper surface of the upper guide member farther on the first direction side than the rib members. The sheet conveying device is configured so that, in a case where the upper guide member is rotated in a state with the sheet conveyance device being pulled out, the flat guide portion comes into contact with an exterior portion of the apparatus main body, and the upper guide member is supported in a position that opens the sheet conveying path.

An image forming apparatus according to another aspect of the present disclosure includes: an apparatus main body; and the sheet conveying device, the sheet conveying device being mounted to the apparatus main body and configured to be able to be pulled out forward from a mounting position where the sheet conveying device is mounted to the apparatus main body, wherein the image forming apparatus conveys a sheet after image formation to either the sheet conveying path of the sheet conveying device or to an upper surface of an upper guide member of the sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Embodiments according to the present disclosure will be described below with reference to the drawings. Note that the following embodiments are examples that embody a technique according to the present disclosure, and do not limit the technical scope of the present disclosure.

[Configuration of Image Forming Apparatus 10]

Figure 1:
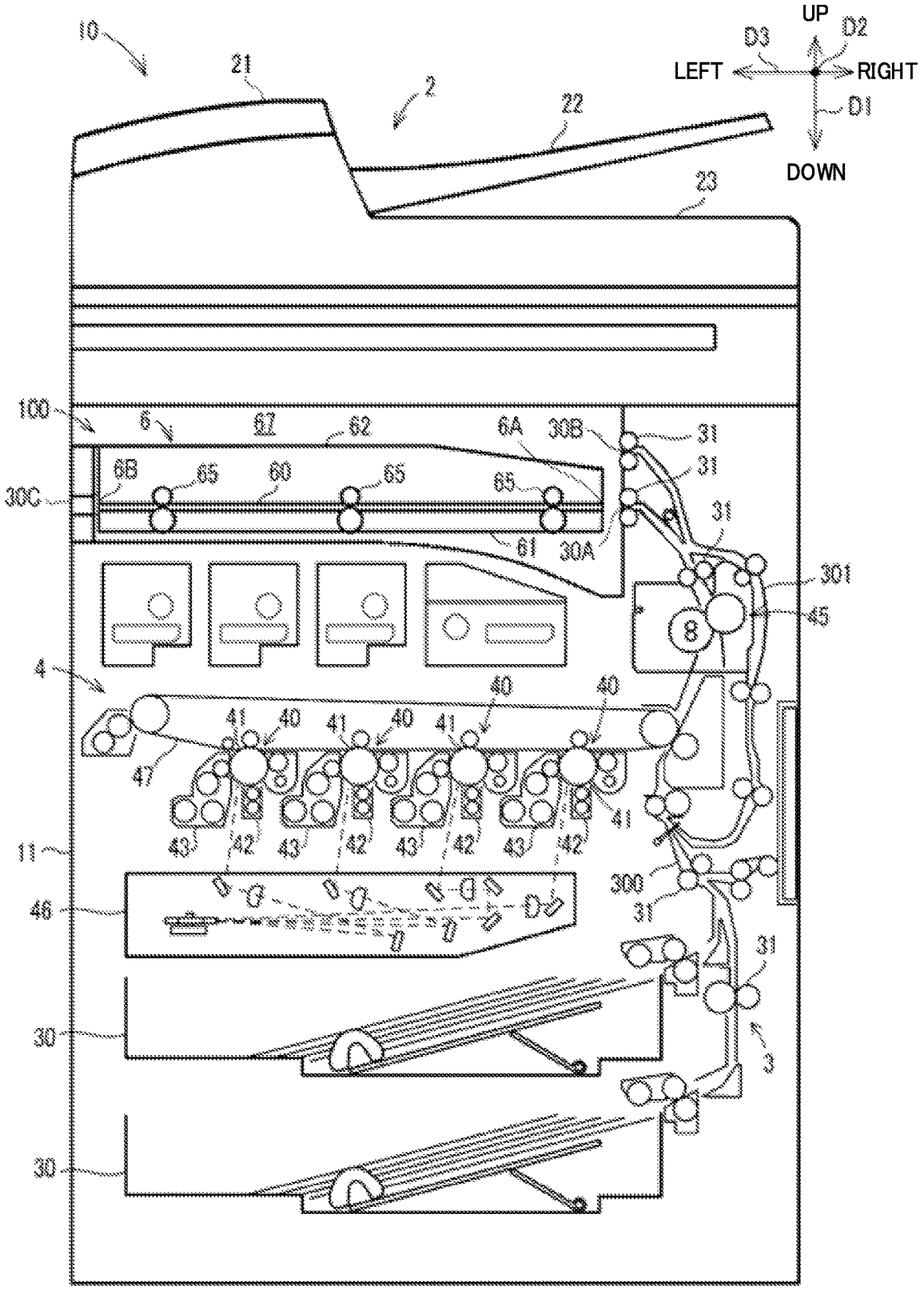
FIG. 1 is a configuration diagram of an image forming apparatus of an embodiment according to the present disclosure.

FIG. 1 is a schematic diagram showing the configuration of an image forming apparatus 10 according to the present embodiment. The image forming apparatus 10 executes a printing process based on an electrophotographic method. The image forming apparatus 10 is, for example, a copying machine or a multifunction peripheral having a copying function, a printing function, a facsimile communication function, and the like. The printing process is a process of forming an image on a sheet such as printing paper. Note that the image forming apparatus 10 may be an apparatus that executes the printing process using a method other than the electrophotographic method, such as an inkjet method.

In the following description, an up-down direction D1 is defined based on the state in which the image forming apparatus 10 is installed as shown in FIG. 1, and a front-rear direction D2 is defined with the front side in FIG. 1 as the front side of the image forming apparatus 10, a left-right direction D3 or a width direction D3 is defined when the image forming apparatus 10 is viewed from the front.

As shown in FIG. 1, the image forming apparatus 10 includes an apparatus main body 11 as a housing, a sheet storing portion 30, a sheet conveying device 3, a printing device 4, and a relay conveying unit 6 (an example of a sheet conveying device according to the present disclosure). The apparatus main body 11 includes the sheet storing portion 30, the sheet conveying device 3, the printing device 4, and the relay conveying unit 6.

In addition, an image reading device 2 is provided at an upper portion of the apparatus main body 11. The image reading device 2 includes a reading unit (not shown) having an imaging device such as a CCD or CIS that reads an image from a document. Furthermore, the image reading device 2 includes an automatic document feeding device 21 on the left side of the image reading device 2. The automatic document feeding device 21 takes out a plurality of documents placed on a tray 22 one by one, conveys the documents sequentially toward a reading position to be read by the reading unit, and discharges the documents to a discharge portion 23 on an upper surface of the image reading device 2.

A unit space 100 in which the relay conveying unit 6 is mounted is maintained inside the apparatus main body 11. The unit space 100 is partitioned below the image reading device 2.

In addition, a main conveying path 300 communicating with the sheet storing portion 30 is formed inside the apparatus main body 11.

The sheet storing portion 30 stores a plurality of sheets. In the example shown in FIG. 1, the image forming apparatus 10 includes a plurality of sheet storing portions 30. The sheet is a sheet-like imaging medium such as paper or resin film.

The sheet conveying device 3 sends out a sheet stored in the sheet storing portion 30 to the main conveying path 300, and further conveys the sheet along the main conveying path 300. The sheet conveying device 3 includes a plurality of main conveying roller pairs 31. Each main conveying roller pair 31 is a pair of conveying rollers consisting of a drive roller and a driven roller. The sheet is conveyed by the main conveying roller pairs 31.

Note that the sheet conveying device 3 includes a conveying motor (not shown). The conveying motor rotationally drives the driving rollers of the plurality of main conveyance roller pairs 31.

The printing device 4 forms an image on a sheet conveyed along the main conveying path 300. In the example shown in FIG. 1, the printing device 4 forms a color image on a sheet using an electrophotographic method. Therefore, the printing device 4 includes four image forming devices 40, a transfer device, and a fixing device 45.

In the image forming device 40, a charging device 42 charges the surface of a drum-shaped photoconductor 41, a laser scanning unit 46 writes an electrostatic latent image on the charged surface of the photoconductor 41, and a developing device 43 develops the electrostatic latent image on the photoconductor 41 into the toner image. Note that the photoconductor 41 is an example of an image-carrying member.

The transfer device transfers toner images of each color, which have been transferred from the surface of the photoconductor 41 onto the intermediate transfer belt 47 in an overlapping manner, onto a sheet that is conveyed along the main conveying path 300. The fixing device 45 fixes the toner image on the sheet by pressing and heating the toner image on the sheet.

The printing device 4 shown in FIG. 1 is capable of executing the printing process of color images in a tandem manner. Therefore, the printing device 4 includes four image forming devices 40 each corresponding to a different color of toner.

The sheet conveying device 3 further includes a path switch arranged at a branch portion of the main conveying path 300. The apparatus main body 11 has a first discharge port 30A and a second discharge port 30B arranged vertically. The first discharge port 30A and the second discharge port 30B are discharge ports of the main conveying path 300, and are discharge ports through which sheets after image formation are discharged. The first discharge port 30A is a lower discharge port, and the second discharge port 30B is an upper discharge port.

The path switch selectively guides the sheet that has passed through the printing device 4 to either the first discharge port 30A or the second discharge port 30B. Thus, the sheet after the image formation is discharged from the apparatus main body 11 through one of the first discharge port 30A and the second discharge port 30B. In the present embodiment, in a case where a sheet printed on one side needs to be reversed for double-sided printing, the second discharge port 30B is selected, and the sheet is temporarily evacuated to a sheet storage space 67 (see FIG. 1), which will be described later. After the evacuated sheet has been returned to the main conveying path 300 again, the sheet is then conveyed to the double-sided conveying path 301. In addition, in a case of conveying a sheet printed on one side or both sides to a predetermined discharge portion to be described later, the first discharge port 30A is selected and the sheet is conveyed to the discharge portion.

[Relay Conveying Unit 6]

The relay conveying unit 6 conveys the sheet discharged from the first discharge port 30A of the apparatus main body 11 along the width direction D3 of the apparatus main body 11, and conveys the sheet from a discharge port 30C on the left side of the apparatus main body 11 to a predetermined discharge portion. The discharge portion is, for example, a sheet holding tray (not shown) that holds sheets, or a post-processing device (not shown) that performs a sorting process, a punching process, a stapling process, or the like on the sheets.

The relay conveying unit 6 has a lower guide member 61 and an upper guide member 62. In addition, the relay conveying unit 6 has a relay conveying path 60 (an example of a sheet conveying path according to the present disclosure) along the width direction D3 between the lower guide member 61 and the upper guide member 62. The upper guide member 62 is rotatably supported with respect to the lower guide member 61 using a rear side of the apparatus main body 11 as a fulcrum. Furthermore, the relay conveying unit 6 includes a plurality of relay roller pairs 65 that convey the sheet along the relay conveying path 60.

The relay conveying path 60 is a sheet conveying path extending in the left-right direction D3. The left-right direction D3 is a direction that is perpendicular to the pull-out direction of the relay conveying unit 6 and along the upper surface of the lower guide member 61, and is an example of the first direction according to the present disclosure. The relay conveying path 60 extends from a relay entrance 6A facing the first discharge port 30A of the apparatus main body 11 to a relay discharge port 6B facing the discharge port 30C. The relay conveying path 60 is a sheet conveying path that extends horizontally and generally straight from the relay entrance 6A to the relay discharge port 6B.

An upper surface of the upper guide member 62 (an upper surface of the relay conveying unit 6) is a portion that receives the sheet discharged from the second discharge port 30B of the apparatus main body 11. In the present embodiment, the upper surface of the upper guide member 62 serves as a discharge tray for receiving sheets and as an evacuation tray into which sheets are temporarily evacuated when reversing the sheets during double-sided printing.

Figure 2:
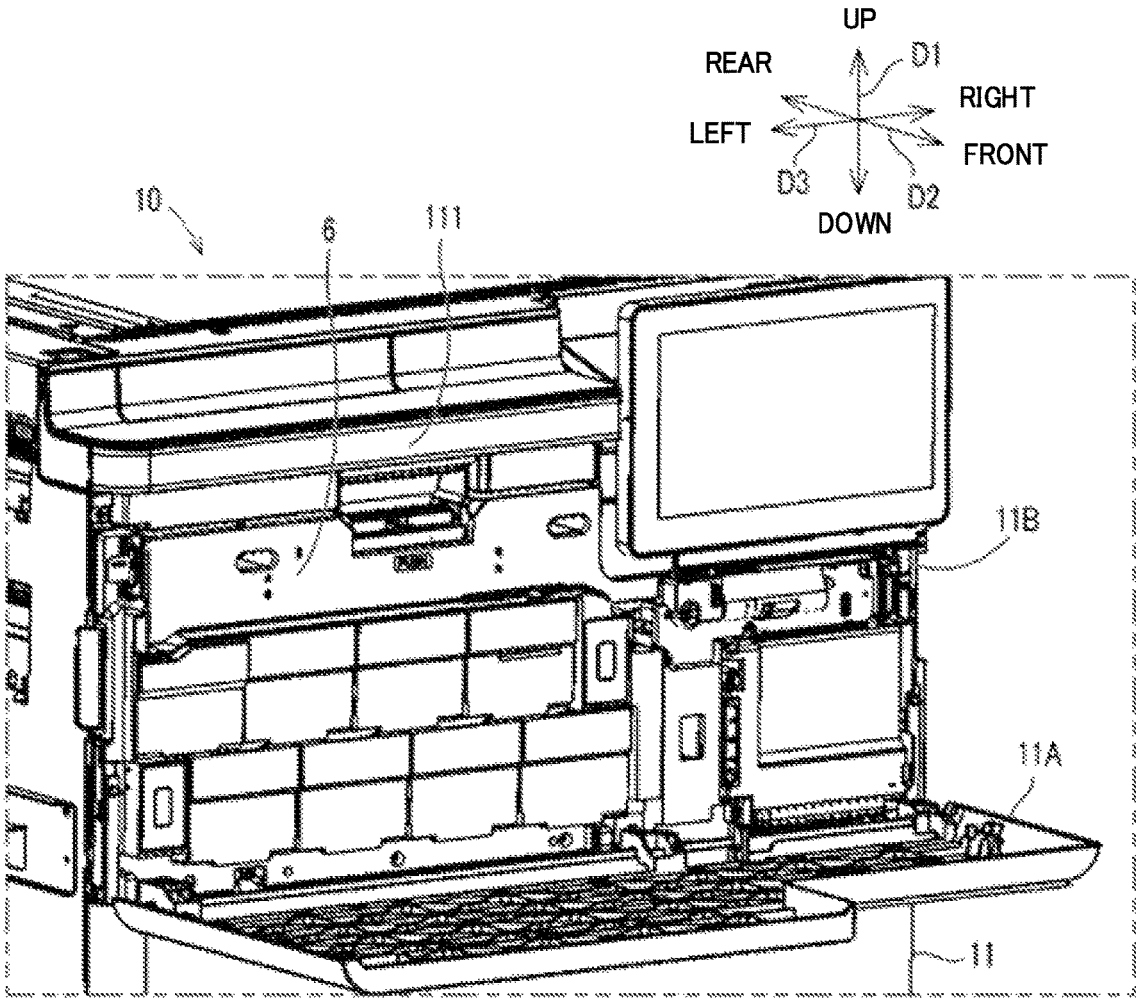
FIG. 2 is a perspective view showing a front side of an image forming apparatus of an embodiment according to the present disclosure, and shows a state in which a front cover is opened.

As shown in FIG. 2, the apparatus main body 11 has a front cover 11A. FIG. 2 shows a state in which the front cover 11A is opened. The front cover 11A is configured to be able to open and close the opening 11B. The front cover 11A is rotatably supported using a vicinity of a lower edge portion of the opening 11B as a rotation fulcrum. By opening the front cover 11A, the opening 11B on the front side of the apparatus main body 11 is opened, and the relay conveying path 60 mounted in the unit space 100 is exposed.

The relay conveying unit 6 is supported so as to be able to be pulled out from the unit space 100 toward the front (front side) of the apparatus main body 11. The relay conveying unit 6 is supported by a known slide mechanism provided in the apparatus main body 11 so as to be able to be pulled out forward from a mounting position set at the back of the unit space 100. By pulling out the relay conveying unit 6 forward from the unit space 100, maintenance such as a jam removal process inside the relay conveying unit 6 can be easily performed.

Figure 3:
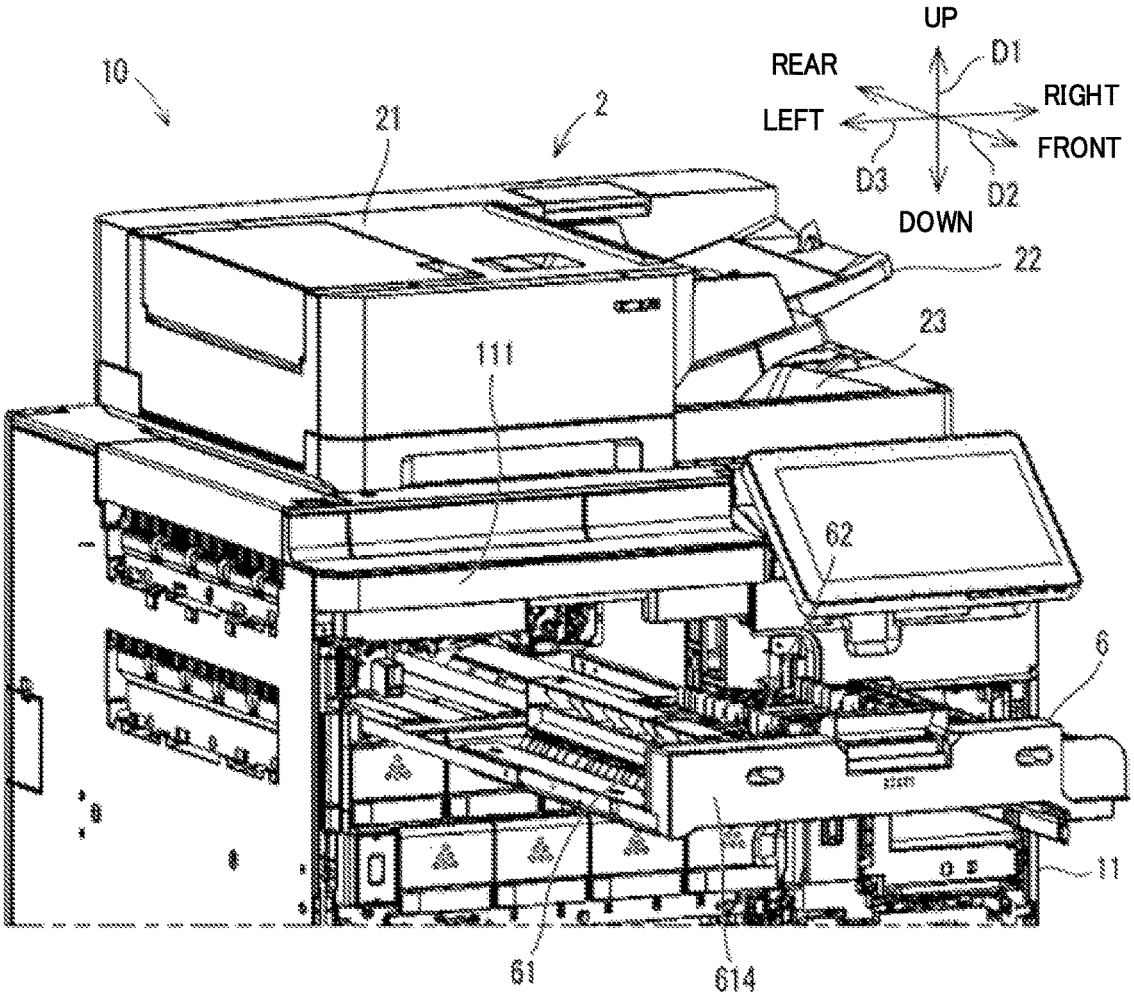
FIG. 3 is a perspective view showing a front side of an image forming apparatus of an embodiment according to the present disclosure, and shows a state in which a relay conveying unit is pulled out forward.
Figure 4:
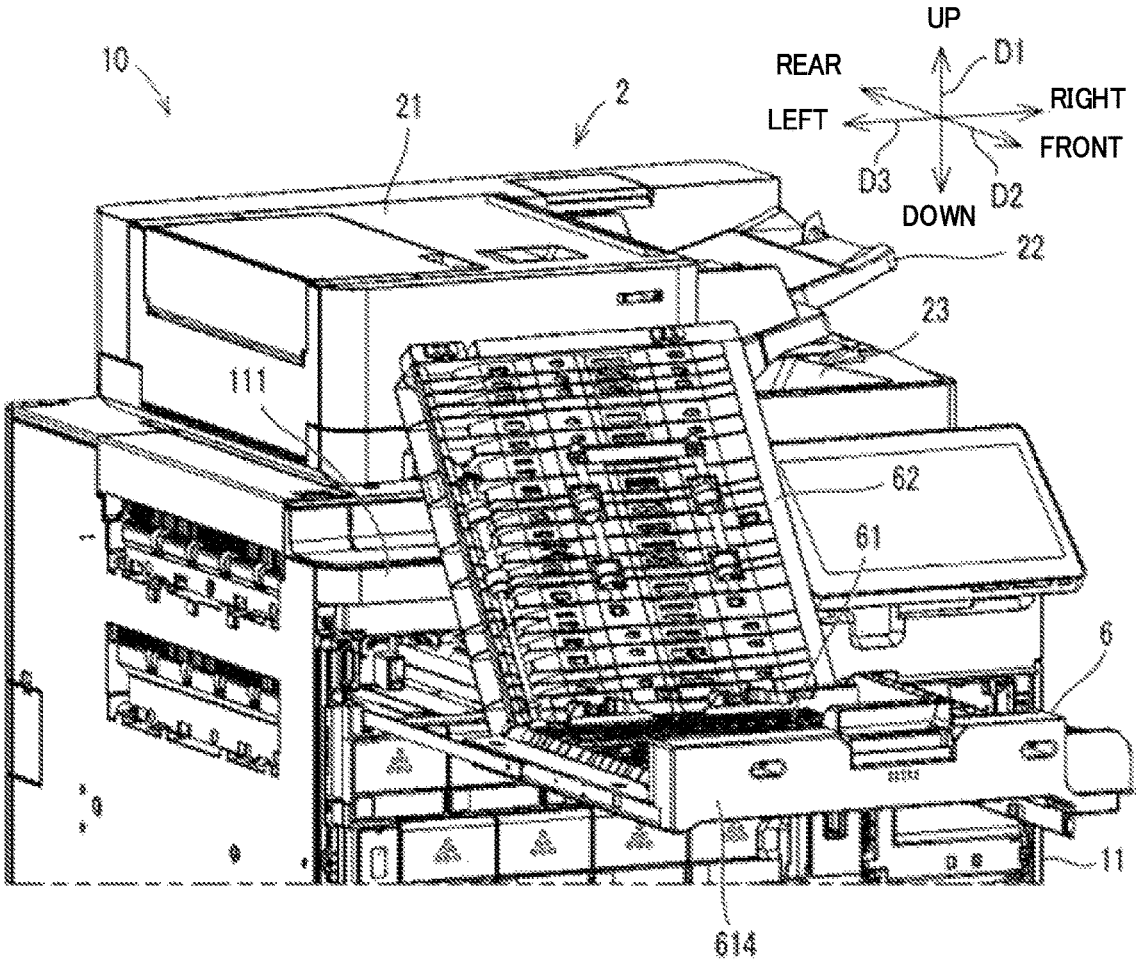
FIG. 4 is a perspective view showing a front side of an image forming apparatus of an embodiment according to the present disclosure, and shows a state in which an upper guide member of the relay conveying unit is rotated upward.

More specifically, in a case where a sheet becomes jammed in the relay conveying path 60 of the relay conveying unit 6, the user first opens the front cover 11A and then pulls out the relay conveying unit 6 forward (see FIG. 3). After that, the user rotates the upper guide member 62 upward to open the relay conveying path 60 (see FIG. 4). Thus, the user can easily perform a jam removal process to remove a sheet that is jammed in the relay conveying unit 6.

However, in a conventional image forming apparatus, when the upper guide member 62 is rotated upward, the upper surface of the upper guide member 62 comes into contact with an exterior portion of the conventional image forming apparatus. Therefore, in a case where the contacting portion has a weak structure, there is a risk that the contacting portion will be damaged.

On the other hand, the image forming apparatus 10 according to the present embodiment has a structure in which the contacting portion of the upper guide member 62 that comes in contact with the exterior of the image forming apparatus 10 is not easily damaged, as will be described later. Therefore, even in a case where the upper guide member 62 is rotated upward and comes into contact with the exterior portion of the image forming apparatus 10, it is possible to prevent the contact portion from being damaged.

Figure 5:
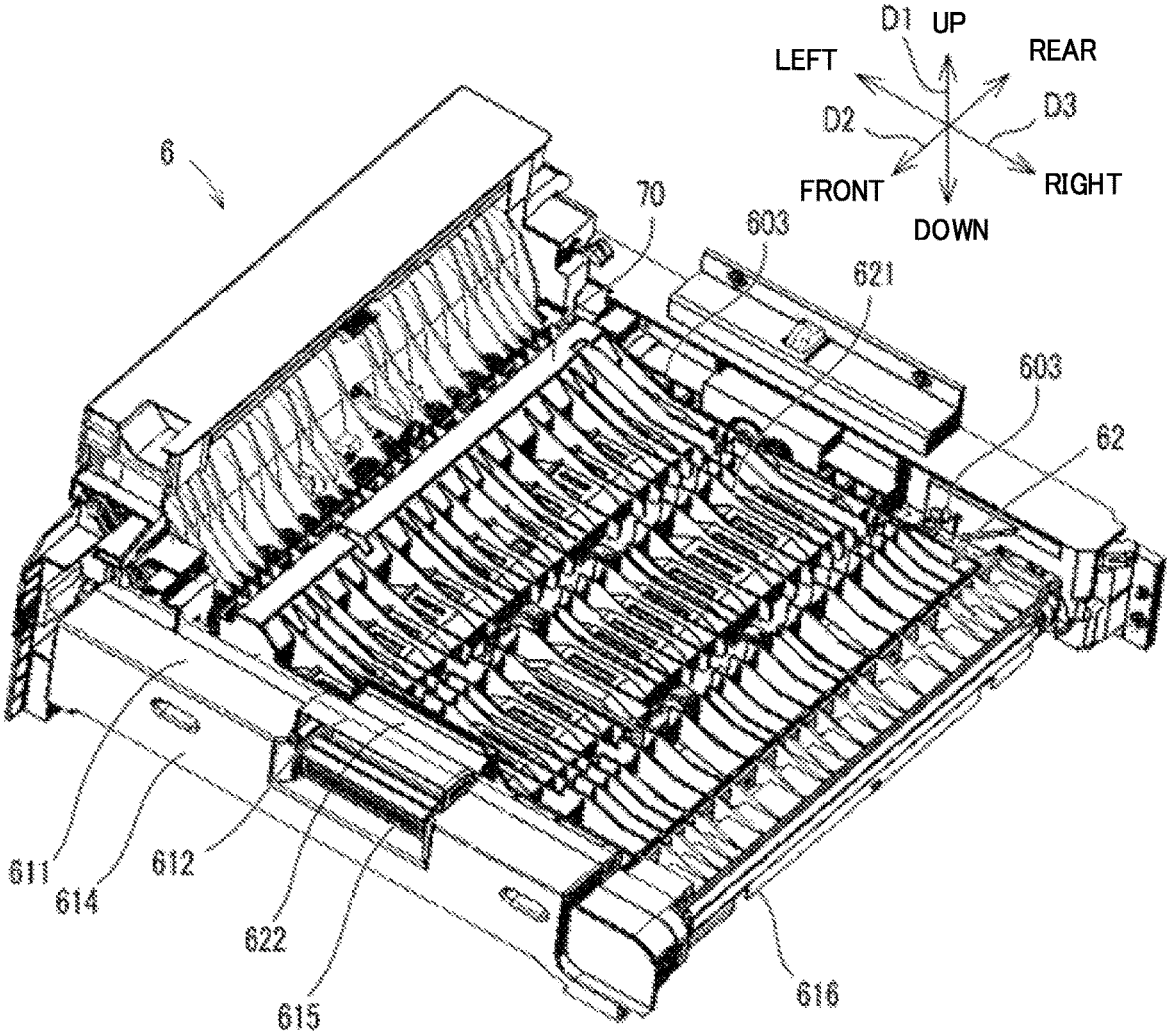
FIG. 5 is a perspective view showing the relay conveying unit of an embodiment according to the present disclosure.
Figure 6:
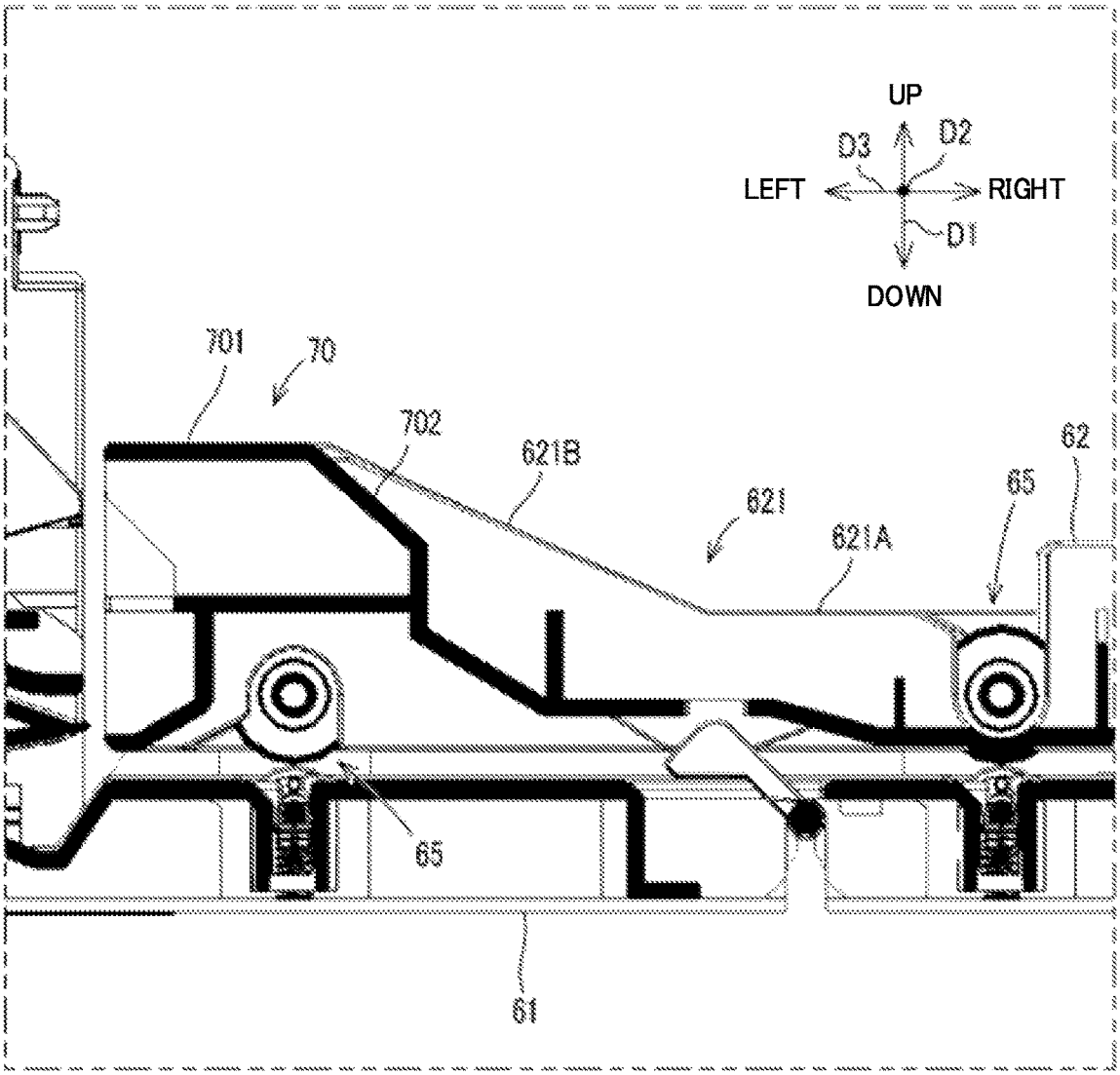
FIG. 6 is a partial cross-sectional view of the relay conveying unit of an embodiment according to the present disclosure.

Hereinafter, the relay conveying unit 6 will be described in detail with reference to FIGS. 5 and 6. FIG. 5 is a perspective view showing the relay conveying unit 6. FIG. 6 is a partial cross-sectional view of the vicinity of a left end portion of the relay conveying unit 6.

The lower guide member 61 includes a plurality of ribs (not shown) extending in the left-right direction D3. These ribs are provided on an upper surface side of the lower guide member 61. The tip-end portions (upper end portions) of these ribs serve as a lower guide surface that guides the lower surface of the sheet being conveyed through the relay conveying path 60. The upper guide member 62 similarly includes a plurality of ribs (not shown) extending in the left-right direction D3. These ribs are provided on a lower surface side of the upper guide member 62. The tip-end portions (lower end portions) of these ribs serve as an upper guide surface that guides the upper surface of the sheet being conveyed through the relay conveying path 60.

As shown in FIG. 5, the upper guide member 62 is arranged above the lower guide member 61. The relay conveying path 60 is formed between the upper guide member 62 and the lower guide member 61. In this embodiment, the relay conveying path 60 is formed by the lower guide surface and the upper guide surface being arranged to face each other vertically with a predetermined interval therebetween.

The relay conveying unit 6 has a hinge portion 603. The hinge portion 603 is provided at a rear end portion of the lower guide member 61. That is, the hinge portion 603 is provided at the rear end portion of the lower guide member 61 on the opposite side to the direction in which the relay conveying unit 6 is pulled out. The hinge portion 603 rotatably supports the upper guide member 62 with respect to the lower guide member 61. That is, the upper guide member 62 is rotatably connected to the lower guide member 61 by the hinge portion 603 on the side of the rear end portion of the relay conveying unit 6.

The lower guide member 61 is a box-shaped member having an upper-surface opening, and the upper guide member 62 is provided so as to cover the upper-surface opening. The upper guide member 62 is in a closed state with respect to the lower guide member 61, and the relay conveying unit 6 is housed in a unit space 100 of the apparatus main body 11 in the closed state. When the relay conveying unit 6 is mounted in a mounting position determined in the unit space 100, a sheet storage space 67 (see FIG. 1, an example of the sheet storing portion according to the present disclosure) extending in the left-right direction D3 is formed between an upper surface of the upper guide member 62 and an internal frame of the apparatus main body 11.

When the relay conveying unit 6 is pulled out from the apparatus main body 11, the user can open the upper guide member 62 upwardly by holding a handle 622 that protrudes from the front end portion of the upper guide member 62.

A front side portion 611 of the lower guide member 61 is provided with an engaged portion 612 that is engaged with the handle 622 when the upper guide member 62 is closed. A decorative panel 614 is further attached forward of the front side portion 611. A handle 615 that is held by the user when the relay conveying unit 6 is pulled out is provided at an approximate center portion in the left-right direction D3 of the decorative panel 614.

In addition, guide rails 616 are attached to a lower right-side edge and a lower left-side edge of the lower guide member 61. The guide rails 616, by being combined with guide rails attached to a side of the apparatus main body 11, forms a slide mechanism that guides the pulling out of the relay conveying unit 6.

The upper guide member 62 includes a plurality of ribs 621 (an example of the rib members according to the present disclosure) extending in the left-right direction D3. These ribs 621 are provided on the upper surface side of the upper guide member 62. The ribs 621 are arranged side-by-side at predetermined intervals in the front-rear direction D2. The tip-end portions (upper end portions) of the ribs 621 serve as guide surfaces that receive sheets discharged from the second discharge port 30B of the apparatus main body 11 and guide the sheets in a discharge direction.

A flat guide portion 70 is provided at a left end portion of the upper guide member 62. The flat guide portion 70 is a portion that comes into contact with an exterior portion 111 (see FIG. 7) of the apparatus main body 11 in a case where the upper guide member 62 is rotated upward in a state with the relay conveying unit 6 being pulled out. More specifically, when the upper guide member 62 is rotated upward and further rotated to a position where it is tilted toward the rear (see FIG. 7), the flat guide portion 70 comes into contact with the exterior portion 111, and thus, the upper guide member 62 maintains the tilted position. In other words, the upper guide member 62 is supported in the tilted position by the flat guide portion 70 coming into contact with the exterior portion 111. Note that by being in the titled position, the relay conveying path 60 of the relay conveying unit 6 is opened. In the present embodiment, the exterior portion 111 is an upper end portion of the front surface of the apparatus main body 11 and an upper edge portion of the opening 11B.

The flat guide portion 70 is provided on a left side of the ribs 621 on the upper surface side of the upper guide member 62. In addition, as shown in FIG. 6, an upper surface portion 701 of the flat guide portion 70 is located farther on the upper side than upper end of the ribs 621. The upper surface portion 701 has a flat surface extending in the front-rear direction D2.

As shown in FIG. 6, each rib 621 includes a straight rib 621A that extends in the left-right direction D3, and an inclined rib 621B that connects a left end portion of the straight rib 621A and the upper surface portion 701 of the flat guide portion 70.

In addition, the flat guide portion 70 has an inclined guide portion 702. The inclined guide portion 702 is provided on the rib 621 side of the flat guide portion 70. The angle of inclination of an inclined surface of the inclined guide portion 702 is larger than the angle of inclination of the inclined ribs 621B with respect to the horizontal plane.

Figure 7:
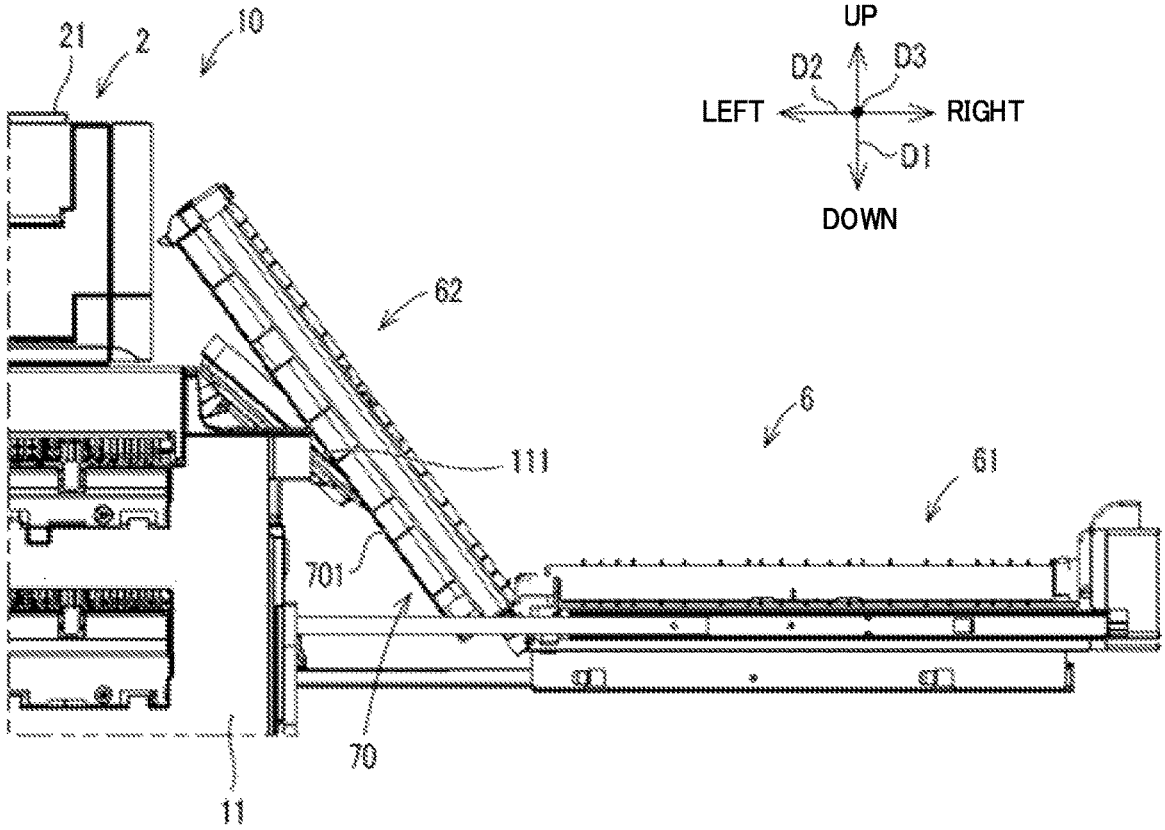
FIG. 7 is a side view of a state in which the upper guide member of the relay conveying unit of an embodiment according to the present disclosure is rotated upward.

As described above, the relay conveying unit 6 includes a lower guide member 61, an upper guide member 62 forming a relay conveying path 60 between the upper guide member 62 and the lower guide member 61, and a hinge portion 603 that rotatably supports the upper guide member 62 with respect to the lower guide member 61, and furthermore, the upper guide member 62 has, on an upper surface thereof, a flat guide portion 70 located farther on the left side than the ribs 621 and farther upward than an upper end of the ribs 621. Thus, as shown in FIG. 7, in a case where the upper guide member 62 is rotated upward while the relay conveying unit 6 is in a state of being pulled out from the apparatus main body 11, the ribs 621 do not come into contact with the exterior portion 111, and the upper surface portion 701 of the flat guide portion 70 comes into contact with the exterior portion 111 of the apparatus main body 11. Therefore, damage to the ribs 621 is prevented. In addition, unlike the ribs 621, the flat guide portion 70 is formed in a shape having the upper surface portion 701 extending in the front-rear direction D2, and thus, in a case where the upper guide member 62 is rotated to the tilted position, even if the flat guide portion 70 comes in contact with the exterior portion 111, the flat guide portion 70 is not easily damaged by the impact at the time of the contact.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device mounted to an apparatus main body of an image forming apparatus and configured to be able to be pulled out forward from a mounting position where the sheet conveying device is mounted to the apparatus main body, the sheet conveying device comprising:

a lower guide member;

an upper guide member that is arranged above the lower guide member and forms a sheet conveying path between the upper guide member and the lower guide member that extends in a first direction along an upper surface of the lower guide member and perpendicular to a pull-out direction; and a hinge portion provided at a rear end portion of the lower guide member on an opposite side to the pull-out direction and rotatably supports the upper guide member with respect to the lower guide member; wherein the sheet conveying device is configured so that a plurality of rib members extending in the first direction are provided on an upper surface of the upper guide member;

a flat guide portion located farther upward than an upper end of the rib members is provided on the upper surface of the upper guide member farther on the first direction side than the rib members; and in a case where the upper guide member is rotated in a state with the sheet conveyance device being pulled out, the flat guide portion comes into contact with an exterior portion of the apparatus main body, and the upper guide member is supported in a position that opens the sheet conveying path.

2. The sheet conveying device according to claim 1, wherein the rib member includes a straight rib extending in the first direction, and an inclined rib that connects an end portion in the first direction of the straight rib and the flat guide portion.

3. The sheet conveying device according to claim 2, wherein an inclined guide portion is provided on the rib member side of the flat guide portion and has an inclination angle with respect to a horizontal plane that is larger than an inclination angle of the inclined rib.

4. The sheet conveying device according to claim 1, wherein in a state with the sheet conveying device mounted at the mounting position, a sheet storing portion extending in the first direction is formed between the upper surface of the upper guide member and an internal frame of the apparatus main body.

5. An image forming apparatus, comprising:

an apparatus main body; and the sheet conveying device according to claim 1, the sheet conveying device being mounted to the apparatus main body and configured to be able to be pulled out forward from a mounting position where the sheet conveying device is mounted to the apparatus main body; wherein the image forming apparatus conveys a sheet after image formation to either a sheet conveying path of the sheet conveying device or to an upper surface of an upper guide member of the sheet conveying device.

* * * * *